United States Patent [19]

Sohn

[11] 4,056,755

[45] Nov. 1, 1977

[54] COLOR PICTURE TUBE HAVING MASK-FRAME ASSEMBLY WITH REDUCED THICKNESS

[75] Inventor: Frank Myung-Hi Sohn, Leola, Pa.

[73] Assignee: RCA Corporation, New York, N.Y.

[21] Appl. No.: 642,733

[22] Filed: Dec. 22, 1975

[51] Int. Cl.[2] ..... H01J 29/80

[52] U.S. Cl. ..... 313/402; 313/348

[58] Field of Search ..... 313/402, 403, 404, 405, 313/406, 407, 408

[56] References Cited

U.S. PATENT DOCUMENTS 3,005,921 10/1961 Godfrey ..... 313/408

*Primary Examiner*—Lawrence J. Dahl

*Attorney, Agent, or Firm*—Glenn H. Bruestle; Dennis H. Irlbeck

[57] ABSTRACT

A mask type color picture tube has a mask electrode attached to a peripheral frame having an L-shaped cross-section which is suspended within the tube adjacent a screen of the tube. The mask includes a curved apertured portion. At least an outer area of the apertured portion lies in a curved plane that passes substantially behind a part of the frame closest to the screen.

3 Claims, 12 Drawing Figures

Fig. 1.
PRIOR ART
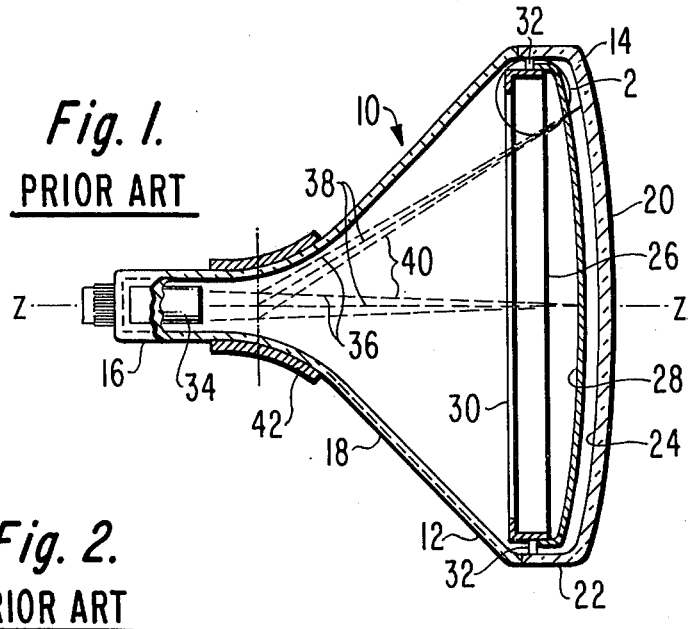
Fig. 2.
PRIOR ART
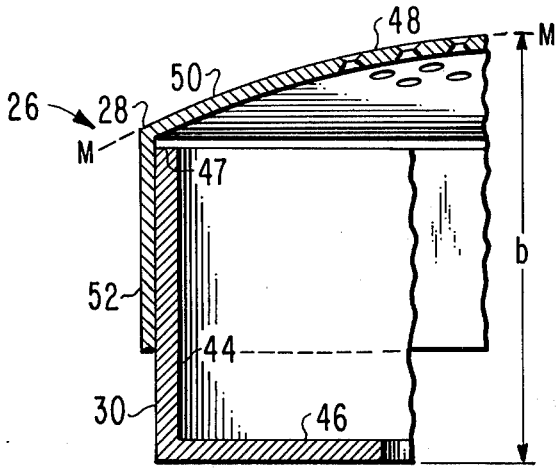
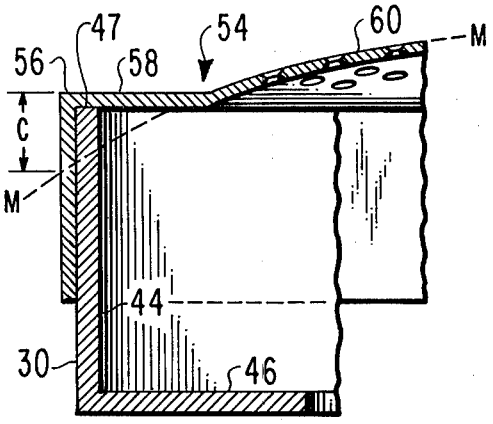
Fig. 3.
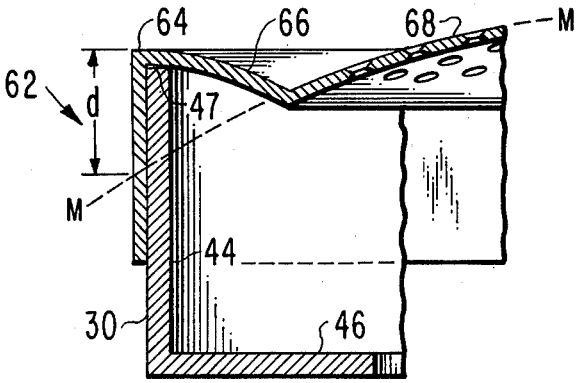
Fig. 4.
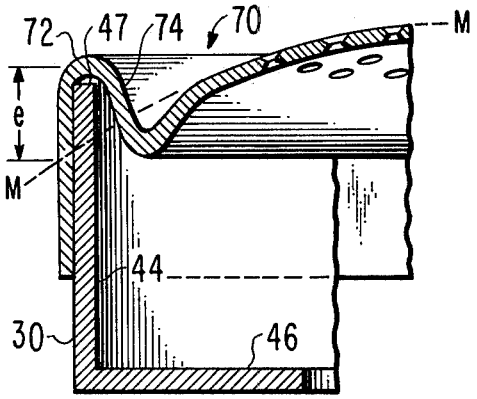
Fig. 5.

COLOR PICTURE TUBE HAVING MASK-FRAME ASSEMBLY WITH REDUCED THICKNESS

BACKGROUND OF THE INVENTION

This invention relates to color picture tubes having apertured mask electrodes therein, and particularly to mask construction that reduces mask-frame assembly thickness.

The most common type of color picture tube for producing a color image is the shadow mask type cathode-ray tube. In this tube type, a plurality of convergent electron beams are projecting through a multi-apertured color selection shadow mask to a mosaic screen. The beam paths through the mask are such that each beam impinges upon and excites only one kind of color-emitting phosphor on the screen. Generally, the shadow mask is attached to a rigid frame, which in turn, is suspended within the picture tube envelope.

Usually, a shadow mask type cathode-ray tube is constructed in two parts comprising a rectangular panel or cap portion and a funnel and neck portion which are eventually sealed together. The shadow mask-frame assembly is supported within the cap by a plurality of springs. In the past, the mask-frame assembly was confined entirely within the cap. However, because of recent improvements in shadow mask design which included increasing the curvature of the mask, the thickness of the mask-frame assembly is so great that a portion of the mask-frame assembly in these newer tubes now extends beyond the protective sidewalls of the cap. This is disadvantageous since the cap must be handled and moved on several occasions during manufacture so that the risk of damage to the mask-frame assembly is greatly increased. Therefore, new designs are necessary to provide reduction in mask-frame assembly thickness so that the entire assembly will fit within the tube cap.

SUMMARY OF THE INVENTION

A mask type color picture tube has a mask electrode attached to a peripheral frame having an L-shaped cross-section which is suspended within the tube adjacent to a screen of the tube. The mask includes a curved apertured portion. At least an outer area of the aperatured portion lies in a curved plane that passes substantially behind a part of the frame closest to the screen.

BRIEF DESCRIPTION OF THE DRAWINGS

FIG. 1 is a plan view, partly in axial section, of a shadow mask color picture tube in which a prior art mask-frame assembly is mounted.

FIG. 2 is a partial section view of the prior art mask-frame assembly of the tube of FIG. 1 taken at noted detail 2.

FIGS. 3 to 12 are partial section views of different embodiments of mask-frame assemblies constructed in accordance with the present invention.

DETAILED DESCRIPTION OF THE PREFERRED EMBODIMENT

Figure 6:
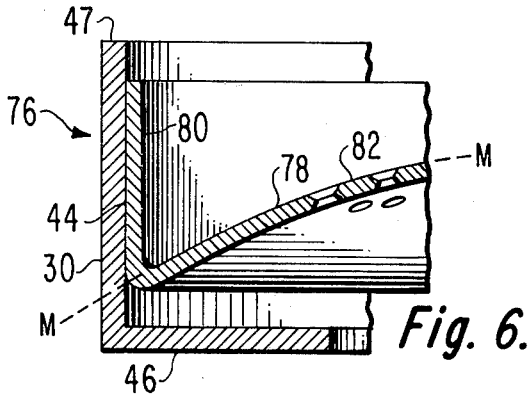

FIG. 1 is a plan view of a rectangular color picture tube 10 having a glass envelope 12 comprising a rectangular panel or cap 14 and a tubular neck 16 connected by a rectangular funnel 18. The panel 14 comprises a viewing faceplate 20 and a peripheral flange or sidewall 22 which is sealed to the funnel 18. A mosaic three-color phosphor screen 24 is located on the inner surface of the faceplate 20. The screen 24 may be either a line screen i.e., comprised of arrays of parallel phosphor lines or strips, or a dot screen, i.e., comprised of arrays of circular phosphor deposits. A mask-frame assembly 26 is located in the cap 14 in spaced relationship to the screen 24. The assembly 26 comprises a multi-apertured color selection electrode or shadow mask 28 which is welded to a reinforcing frame 30 which, in turn, is supported within the cap 14 by several springs 32. An electron gun 34 is mounted within the neck 16 to generate and direct three electron beams 36, 38 and 40 along convergent paths through the apertures of the mask 28 to the screen 24.

The tube of FIG. 1 is designed to be used with an external magnetic deflection yoke 42 surrounding the neck 16 and funnel 18, in the vicinity of their junction. When appropriate voltages are applied to the yoke 42, the three beams 36, 38 and 40 are subjected to vertical and horizontal magnetic fields that cause the beams to scan horizontally and vertically in a rectangular raster over the screen 24.

The prior art mask-frame assembly 26 of the tube 10 of FIG. 1 is shown in enlarged detail in FIG. 2. As noted, the assembly 26 comprises a shadow mask 28 attached to a frame 30. The frame 30 is rectangular to conform to the shape of the tube cap 14 and has an L-shaped cross-section. When installed in a tube, a first flange 44 of the frame 30 is parallel to the central longitudinal axis Z—Z of the tube while the second flange 46 somewhat parallels the screen and is perpendicular to the longitudinal axis Z—Z. The mask 28 of this assembly 26 is a thin metal sheet having an apertured central portion 48 surrounded by an imperforate border 50 and a peripheral skirt 52. The skirt is shaped to conform to and to telescope over the first flange 44 of the frame 30 and is welded to the flange 44. The apertured portion 48 and border 50 of the mask 28 are substantially spherically contoured and, for at least the portion shown in FIG. 2, lie within a curved plane designated M—M. Actually, curved plane M—M is defined to include only the forward surface of the mask facing the screen. As can be seen in FIG. 2, the curved plane M—M passes in front of the leading edge 47 of the flange 44; designating the screen end of the tube as the front. The mask-frame assembly thickness *b* is measured parallel to the central longitudinal axis Z—Z of the tube, which in the assembly 26 is from the bottom or outside of flange 46 to the peak of the curved mask 28. For purposes of illustration, assembly thickness *b* is shown measured at an arbitrary point close to the edge of the assembly 26, however, it should be understood that the maximum thickness probably lies at the center of the assembly. It is this thickness that the following embodiments of the present invention reduce.

FIGS. 3–12 illustrate ten different embodiments of mask-frame assemblies constructed in accordance with various aspects of the present invention. In all of the following embodiments, the same frame 30 is used as that used in the assembly 26 of FIG. 2. Similarly, in each of the figures, the curved plane containing at least the outer area of the apertured portion of a mask is designated M—M. Furthermore, in each embodiment, mask frame assembly thickness is reduced compared to the described prior art assembly.

In a mask-frame assembly 54 shown in FIG. 3, wherein, similar to the assembly 26 of FIG. 2, a mask 56 is telescoped over the frame 30, reduction in assembly thickness is accomplished by shaping the mask 56 so that its border 58 parallels the second flange 46 of the frame 30. By so contouring the border 58, the curved plane M—M containing at least the outer area of the apertured portion 60 of the mask 56 passes substantially behind the leading edge 47 of the flange 44. This configuration results in a decrease *c* in assembly thickness.

Another mask-frame assembly 62, wherein a mask 64 is again telescoped over the frame 30, is shown in FIG. 4. The mask 64 in this assembly 62 is similar to the mask 56 of FIG. 3 except that the mask border 66 dips behind the leading edge 47 of the flange 44 toward the flange 46. Thus, the curved plane M—M containing the apertured portion 68 of the mask 64 passes further behind the leading edge 47 thereby providing an even greater reduction *d* in assembly thickness.

In a third mask-frame assembly 70 having a mask 72 telescoped over the frame 30, shown in FIG. 5, reduction of assembly thickness is accomplished by forming a border 74 so that its cross-section resembles an S-shape. The reduction in assembly thickness using this assembly is designated "*e.*"

Without changing frame design, the greatest reduction in thickness can be accomplished by placing the entire mask within the frame. FIG. 6 shows a mask-frame assembly 76 having a mask 78 including a skirt 80 of reversed direction so that it points forward toward the screen of a tube. The outer dimensions of the mask 78 are restricted so that the mask 78 telescopes within the flange 44 of the frame 30. As can be seen, a maximum reduction in assembly thickness can be realized with this assembly 76 without modifying the frame 30 if the mask 78 is telescoped completely within the frame or at least far enough that no part of the apertured portion 82 extends forward of the leading edge 47.

Figure 7:
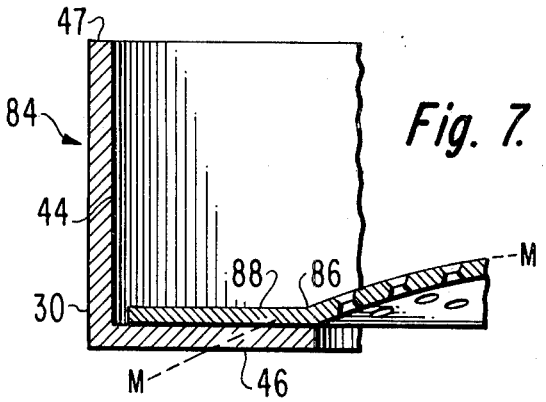

An alternate mask-frame assembly 84 wherein a mask 86 can be completely enclosed within the frame 30, if mask curvature is not too great, is shown in FIG. 7. This mask 86 has no skirt but rather has a flattened border 88, similar to border 58 in FIG. 3, directly attached to the inside of the second flange 46 of the frame 30. This embodiment results in a minimum assembly thickness since the thickness is simply determined either by the length of the flange 44 or by the dome thickness of the mask 86. It should be appreciated, however, that in this assembly 84 and in the following embodiment, practical mask-screen spacings may require the shortening of the flange 44.

Figure 8:
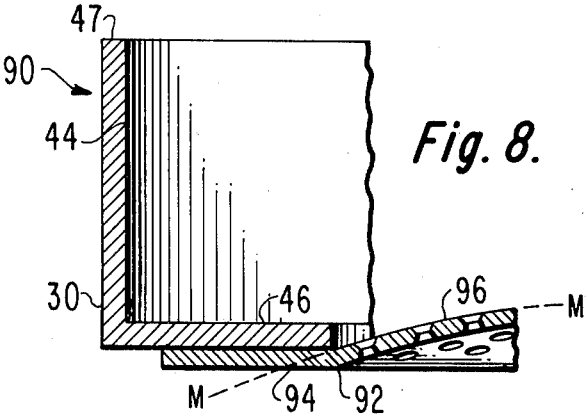

In another mask-frame assembly 90, shown in FIG. 8, a non-skirted mask 92, similar to the mask of FIG. 7 has a border 94 welded to the backside of the flange 46. This assembly 90 has its entire curved apertured portion 96 arched up within the frame and therefore offers great reduction in assembly thickness.

Figure 9:
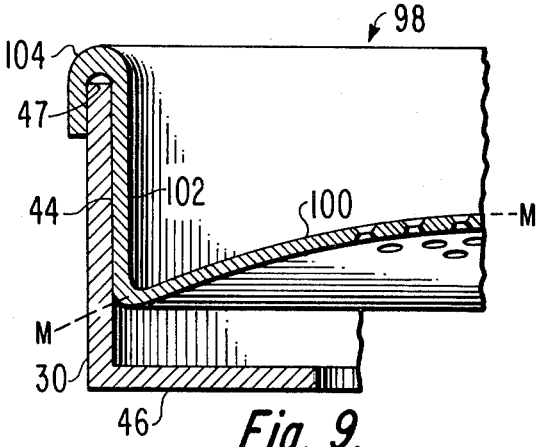

FIG. 9 shows a mask-frame assembly 98, similar to the assembly 76 of FIG. 6, wherein a mask 100 having a reversed forward pointing skirt 102 includes a skirt extension 104 that hooks around the leading edge 47 of the flange 44. This embodiment simplifies installation of the mask 100 in the frame 44 while reducing assembly thickness.

Figure 10:
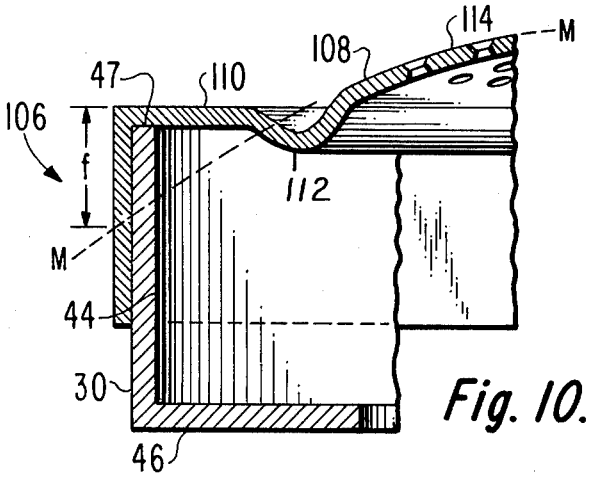

A mask-frame assembly 106 that is a modification of the assembly 54 of FIG. 3 is shown in FIG. 10. A mask 108 in this assembly 106 has a border 110 that includes an indentation or bead 112 extending around an apertured portion 114. Such bead 112 can add to the strength of the formed mask 108. In this particular example, assembly thickness is shown being reduced by a fact or *f* which is slightly greater than the reduction *c* of the FIG. 3 embodiment.

Figure 11:
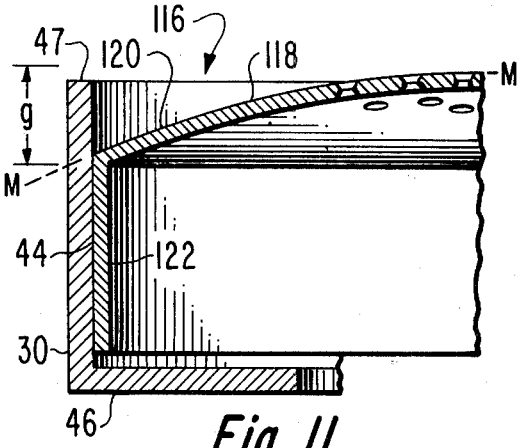

FIG. 11 shows a mask-frame assembly 116 wherein a mask 118 having a conventional shaped border 120 and skirt 122, is reduced in outer dimensions so that it telescopes within the flange 44 of the frame 30 thereby reducing assembly thickness by a factor *g.*

Figure 12:
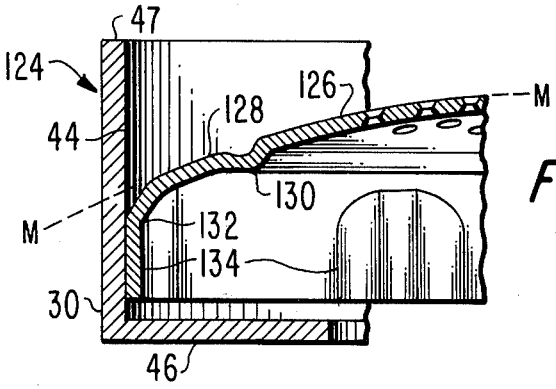

Another mask-frame assembly 124 is shown in FIG. 12. This assembly 124 has a mask 126 that includes a border 128 with a bead 130 in it and a skirt 132 telescoped within the frame 30. The skirt 132 includes a plurality of flutes 134, the extreme portions of which contact the flange 44. The flutes 134 permit limited attachment of the mask 126 to the frame 30 which helps prevent warping of the mask during tube operation.

In several of the foregoing examples, e.g., assemblies 116 and 124 in FIGS. 11 and 12, respectively, placement of the mask skirt within the frame provides other advantages. For example, during tube operation, the electron beams normally over-scan the apertured portion of the mask and, with the skirt inside the frame, some electrons will strike the skirt thus causing it to heat up. Because of this heating, the temperature of the skirt will be closer to the temperature of the apertured portion and border of the mask. Reduction of temperature differentials in the mask is especially important during tube warmup since these temperature differentials cause mask warpage or doming.

Of course, placement of the mask inside the frame also provides a margin of safety for the mask since it is protected by the frame. Because of this, the incidence of dented masks can be greatly reduced.

Although the foregoing embodiments of the present invention have been described with respect to a shadow mask type of color picture tube, it is to be understood that the scope of the invention also includes tubes having other types of mask electrodes, e.g., focus mask and focus grill.

I claim:

1. In an apertured mask type color picture tube having a mask attached to a peripheral frame which is suspended within said tube adjacent a screen of said tube, said frame including a flange substantially parallel to the longitudinal axis of said tube, said mask including a domed central apertured portion, a border portion surrounding said apertured portion and a skirt portion surrounding said border portion, the improvement comprising, said mask being telescoped within said frame and at least a part of said skirt portion being parallel with said flange and extending toward said screen.

2. In an apertured mask type color picture tube having a mask attached to a peripheral frame of L-shaped cross-section which is suspended within said tube adjacent a screen of said tube, said frame including a first flange substantially parallel to the longitudinal axis of said tube and a second flange extending toward the longitudinal axis of said tube, said mask including a domed curved central apertured portion and a border peripheral to said apertured portion, the improvement comprising, said border being parallel with and attached to said second flange.

3. In an apertured mask type color picture tube having a rectangular mask attached to a peripheral frame of L-shaped cross-section which is suspended within said tube adjacent a screen of said tube, said frame including a first flange substantially parallel to the longitudinal axis of said tube, and a second flange transverse to said first flange, said first flange extending from said second flange toward said screen and said second flange extending from said first flange toward the center of said tube, said mask including a curved central apertured portion, a border portion surrounding said apertured portion and a skirt portion surrounding said border portion, the improvement comprising, said mask being telescoped within said frame with the distal edge of said skirt portion being closer to the proximal edge of said first flange where said first and second flanges join than to the distal edge of said first flange, whereby the mask-frame assembly has reduced thickness measured along said longitudinal axis of said tube relative to a prior art tube having a frame of similar dimensions.

* * * * *